US010934063B2

(12) United States Patent
Benoit-Gonin et al.

(10) Patent No.: US 10,934,063 B2
(45) Date of Patent: Mar. 2, 2021

(54) TAMPER-EVIDENT CLOSURES

(71) Applicant: Obrist Closures Switzerland GMBH, Reinach (CH)

(72) Inventors: Claude Benoit-Gonin, Odenas (FR); Phillipe Bardet, Gleize (FR)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 248 days.

(21) Appl. No.: 16/074,664

(22) PCT Filed: Jan. 25, 2017

(86) PCT No.: PCT/EP2017/051547
§ 371 (c)(1),
(2) Date: Aug. 1, 2018

(87) PCT Pub. No.: WO2017/133948
PCT Pub. Date: Aug. 10, 2017

(65) Prior Publication Data

US 2019/0039787 A1 Feb. 7, 2019

(30) Foreign Application Priority Data

Feb. 1, 2016 (GB) ..... 1601789

(51) Int. Cl.
*B65D 41/34* (2006.01)
*B65D 41/48* (2006.01)
*B65D 47/08* (2006.01)

(52) U.S. Cl.
CPC ..... *B65D 41/3428* (2013.01); *B65D 41/485* (2013.01); *B65D 47/0852* (2013.01)

(58) Field of Classification Search
CPC ..... B65D 41/38; B65D 41/3419; B65D 41/3428; B65D 41/3438; B65D 41/3404;
(Continued)

(56) References Cited

U.S. PATENT DOCUMENTS 1,545,227 A * 7/1925 Baltzley ..... B65D 45/32 215/272
3,850,329 A * 11/1974 Robinson ..... B65D 41/3419 215/254
(Continued)

FOREIGN PATENT DOCUMENTS

CN 1200345 A 12/1998
EP 0861792 A1 9/1998
(Continued)

OTHER PUBLICATIONS

National Intellectual Property Administration, P.R.C, Office Action dated May 15, 2019 for Chinese Patent Appl. No. 201780009039.1, May 15, 2019.
(Continued)

*Primary Examiner* — Ernesto A Grano
(74) *Attorney, Agent, or Firm* — James F. Lea, III; Gable Gotwals

(57) ABSTRACT

A tamper-evident screw closure (1) is provided and comprises: a head plate (2); a substantially cylindrical skirt (3) having an internal screw thread (4); and a tamper-evident drop band (11), the band being frangibly connected to the lower edge of the skirt. The band comprises a first portion (12) directed downwardly from the cap skirt and a second portion (14) which extends from the lower end of the first portion and which is folded over inwardly and back in the direction of the head plate for engaging behind a securing ring on a container neck. At least one extension (15) is provided in axial extension of the second portion. The extension is provided with one or more notches (18) and the interior of the skirt is provided with one or more corresponding projections (20) which locate in the notches when the second portion is folded. Wherein when the closure is unscrewed the skirt breaks away from the band, and when
(Continued)

the skirt is reapplied to the container neck the projections can push on the extension to ensure that the band drops away from the skirt.

20 Claims, 6 Drawing Sheets

(58) Field of Classification Search
CPC .. B65D 41/34; B65D 41/3409; B65D 41/485; B65D 47/0852
USPC ..... 215/44
See application file for complete search history.

(56) References Cited

U.S. PATENT DOCUMENTS 4,801,030 A * 1/1989 Barriac ..... B65D 41/3428 215/252
4,813,561 A * 3/1989 Ochs ..... B65D 41/3409 215/252
4,848,614 A * 7/1989 Csaszar ..... B65D 41/3428 215/252
4,981,230 A * 1/1991 Marshall ..... B65D 41/3428 215/252
5,007,545 A * 4/1991 Imbery, Jr. ..... B29C 33/485 215/14
5,400,913 A * 3/1995 Kelly ..... B65D 41/3428 215/252
5,443,853 A 8/1995 Hayes
5,472,106 A * 12/1995 Nofer ..... B65D 41/3428 215/256
5,660,289 A 8/1997 Spatz et al.
5,727,705 A * 3/1998 Kelly ..... B65D 41/3428 215/252
5,755,347 A * 5/1998 Ingram ..... B29C 57/00 215/252
6,116,442 A * 9/2000 Higgins ..... B65D 41/3428 215/252
6,119,883 A * 9/2000 Hock ..... B65D 41/3428 215/252
6,123,212 A * 9/2000 Russell ..... B65D 41/0471 215/307
6,152,316 A * 11/2000 Niese ..... B65D 41/3428 215/252
6,253,939 B1 * 7/2001 Wan ..... B65D 41/3428 215/252
6,253,940 B1 * 7/2001 Graham ..... B65D 41/3423 215/252
6,371,317 B1 * 4/2002 Krueger ..... B65D 41/3428 215/252
6,405,886 B1 * 6/2002 Gearhart ..... B65D 41/3428 215/252
6,484,896 B2 * 11/2002 Ma ..... B65D 41/3409 215/252
6,491,175 B1 * 12/2002 Taha ..... B29C 45/262 215/252
6,766,916 B2 * 7/2004 Ma ..... B65D 41/3428 215/252
8,251,236 B1 * 8/2012 Robinson ..... B65D 41/3428 215/276
8,544,666 B2 * 10/2013 Velmer ..... B65D 41/3428 215/331
8,596,477 B2 * 12/2013 Kras ..... B65D 41/0442 215/276
10,214,325 B2 * 2/2019 Rognard ..... B65D 41/3428
2001/0015341 A1 * 8/2001 Higgins ..... B29C 45/33 215/252
2002/0070236 A1 * 6/2002 Wolf ..... B65D 41/3419 222/153.05
2003/0098285 A1 * 5/2003 Gregory ..... B65D 41/045 215/252
2003/0098286 A1 * 5/2003 Bloom ..... B65D 41/045 215/349
2004/0060893 A1 * 4/2004 Kano ..... B65D 41/0421 215/344
2005/0072751 A1 * 4/2005 Price ..... B65D 41/3428 215/252
2005/0189312 A1 * 9/2005 Bixler ..... B65D 41/3428 215/252
2005/0252878 A1 * 11/2005 Babcock ..... B65D 41/3404 215/252
2006/0021959 A1 * 2/2006 Falzoni ..... B65D 41/3428 215/252
2006/0113272 A1 * 6/2006 Rodriguez ..... B65D 41/3419 215/252
2007/0187352 A1 * 8/2007 Kras ..... B65D 51/18 215/276
2007/0257002 A1 * 11/2007 Pucci ..... B65D 41/3428 215/252
2008/0173611 A1 * 7/2008 Neputy ..... B65D 41/3423 215/256
2008/0264894 A1 * 10/2008 Loughrin ..... B65D 41/045 215/256
2010/0032402 A1 * 2/2010 Widmer ..... B65D 41/3428 215/252
2017/0240326 A1 * 8/2017 Rognard ..... B65D 41/34
2018/0170628 A1 * 6/2018 Rognard ..... B65D 47/0804
2019/0344933 A1 * 11/2019 Kim ..... B65D 41/3447

FOREIGN PATENT DOCUMENTS

EP 0949156 A2 10/1999
EP 2666730 A1 11/2013
GB 2223748 A 4/1990
WO WO2015162128 A1 10/2015

OTHER PUBLICATIONS

Great Britain Intellectual Property Office, Search Report for GB 1601789.9, dated Mar. 9, 2016.
European Patent Office, International Search Report for PCT/EP2017/051547, dated Mar. 16, 2017.

* cited by examiner

TAMPER-EVIDENT CLOSURES

The present invention relates generally to closures and particularly to tamper-evident closures having a mechanism for informing a user if a closure has been opened/accessed at least once.

The present invention relates to a tamper-evident system for ensuring that a tamper-evidencing event is shown clearly; that there is a strong visual difference between the initial, unopened condition and the condition after tamper-evidencing has been activated.

According to an aspect of the present invention there is provided a tamper-evident screw closure, the closure comprising: a head plate; a substantially cylindrical skirt having an internal screw thread; and a tamper-evident drop band, the tamper-proof band being frangibly connected to the lower edge of the skirt, the band comprising a first portion directed downwardly from the cap skirt and a second portion which extends from the lower end of the first portion and which is folded over inwardly and back in the direction of the head plate for engaging behind a securing ring on a container neck, at least one extension is provided in axial extension of the second portion, wherein the extension is provided with one or more notches and the interior of the skirt is provided with one or more corresponding projections which engage in the notches when the second portion is folded, when the closure is unscrewed the skirt breaks away from the band, and when the skirt is reapplied to the container neck the projections can push on the extension to ensure that the band drops away from the skirt.

A further aspect provides a tamper-evident closure for a container, the closure comprising a base or body attachable to a container neck, the base/body comprising a sidewall having a tamper-evident drop band, the band comprising a first portion directed downwardly from the cap skirt and a second portion which extends from the lower end of the first portion and which is folded over inwardly and back towards the sidewall for engaging behind a securing ring on a container neck, at least one extension is provided in axial extension of the second portion, wherein the extension is provided with one or more notches and the interior of the sidewall is provided with one or more corresponding projections which engage in the notches when the second portion is folded, when the closure is unscrewed the body/base breaks away from the band, and when the skirt is reapplied to the container neck the projections can push on the extension to ensure that the band drops away from the body/base.

A further aspect provides a flip-top sportscap closure for a container neck, the sportscap comprising a screw-threaded base and a lid joined by a hinge, the base comprising a sidewall at one end of which a tamper-evident drop-band is frangibly connected, the band comprising a first portion directed downwardly from the cap skirt and a second portion which extends from the lower end of the first portion and which is folded over inwardly and back in the direction of the lid for engaging behind a securing ring on a container neck, at least one extension is provided in axial extension of the second portion, wherein the extension is provided with one or more notches and the interior of the sidewall is provided with one or more corresponding projections which engage in the notches when the second portion is folded, when the closure is unscrewed the base breaks away from the band, and when the skirt is reapplied to the container neck the projections can push on the extension to ensure that the band drops away from the base.

The or each notch may be formed at or towards the free edge of the extension.

The or each notch may be generally quadrilateral in shape e.g. square or rectangular (with one side open).

The extension may comprise one or more flaps. For example the extension may comprise a plurality of flaps.

The extension may comprises a plurality of flaps, for example being a generally annular structure punctuated by notches, slots or the like.

In some embodiments a plurality of flaps are provided; the flaps are arcuate and are circumferentially spaced from each other by notches.

Flaps and/or notches may all be the same circumferential length as each other; alternatively different sizes may be present in the same closure.

In some embodiments the notches are the same depth as the flaps i.e. the notches start from the second portion.

In some embodiments the projections and notches are so arranged that the projections are in driving engagement with the notches as the closure is screwed onto a container neck, whereby to help with co-rotation of the skirt and the band during application.

The projections may be configured to be in driving engagement with the notches as the closure is unscrewed, whereby to assist with breakage of the frangible connection with the drop band.

The second portion may have a generally triangular- or wedge-like section, with an upper abutment surface formed which engages under a container neck bead/ring and prevents the band from passing thereover so as to cause release of the band from the remainder of the closure upon first unscrewing.

The projection/s may be generally square or rectangular.

In some embodiments the closure comprises a tamper-evident drop band frangibly attached to the free end of a closure side skirt forming part of a main body or base. The drop band is formed so that if the closure is removed and then replaced the main body pushes down onto part of the band.

In some embodiments the body can push the band down until it contacts a container neck transfer bead or the like.

A further aspect provides a tamper-evident screw closure, the closure comprising: a head plate;

a substantially cylindrical skirt having an internal screw thread; and a tamper-evident drop band, the tamper-proof band being frangibly connected to the lower edge of the skirt, the TEB being retained on a container neck after separation from the cap skirt in use of the closure the band comprising a first portion directed downwardly from the cap skirt and a second portion which extends from the lower end of the first portion and which is folded over inwardly and back in the direction of the head plate for engaging behind a securing ring on a container neck, at least one an annular extension is provided in axial extension of the second portion, wherein the extension is provided with one or more notches around its periphery and the interior of the skirt is provided with one or more corresponding projections around its periphery which engage in the notches when the second portion is folded, the annular extension and the projections coinciding radially;

when the closure is unscrewed the skirt breaks away from the band, and when the skirt is reapplied to the container neck the projections can push on the extension to ensure that the band drops away from the skirt.

In some embodiments the present invention provides an anti-sabotage plug composed of a body A and a slit inviolability belt B with an inverted lip.

The latching part of the lip is extended by a cylindrical element or sectors of small thickness, called "hook or hook" 2, which guarantee the correct positioning of the lip relative to the ring for attaching the neck.

To facilitate understanding of the drawing, the hook function will be a complete cylinder 3.

In case of design with the use of sectors for this function, interruptions, by their dimensioning, will have no influence on the basic principle presented below.

Concept to facilitate the functioning of the inviolability.

Presence in the hooks of one or more notches 4. In front of these notches, the presence of bearing pins 5 in the lower part of the stopper. When turning the lip, the bearing blocks are located in the notches. Depending on the width adjustment between the notches and the bearing blocks, when the stopper is screwed onto the neck, The bearing blocks participate in the rotational drive of the tamper-proof strip:

The bridges of the tamper-evident belt are less stressed

Possible reduction of the section of bridges

Break easier to unscrew

Concept allowing a good visualization of the breakage of the tamper-evident belt.

When unscrewing the cap, breaking the bridges of the tamper-evident belt, but the belt is likely to remain in place (up position) against the tamper evident ring due to the hooks (FIG. 6).

When replacing the cap, it will be practically impossible to reposition the bearing blocks in their notches. they will come.

On the top of the hooks (FIG. 7), which will push the tamper-evident belt under the collar of the neck.

Low position on the neck (FIG. 8)

In some embodiments there is engagement between the body and the TE band which can help during the screwing operation to drive the TE band in the same time as the shell. This is normally done by the bridges. Because this helps the TE band, the bridges are less stress, we can lightweight these bridges and during opening operation so that the inviolabity is easier to achieve. And there is a double functionality, because when reclosing, the hooks cannot be in the original position and push the band at the bottom and can give a visibility of first opening.

The present invention also provides a container fitted with a closure as described herein.

The present invention also provides, in combination, a tamper-evident screw closure and a container neck, the closure comprising: a head plate; a substantially cylindrical skirt having an internal screw thread; and a tamper-evident drop band, the band being frangibly connected to the lower edge of the skirt, the band comprising a first portion directed downwardly from the cap skirt and a second portion which extends from the lower end of the first portion and which is folded over inwardly and back in the direction of the head plate for engaging behind a securing ring on the container neck, at least one extension is provided in axial extension of the second portion, wherein the extension is provided with one or more notches and the interior of the skirt is provided with one or more corresponding projections which locate in the notches when the second portion is folded, and wherein when the closure is unscrewed the skirt breaks away from the band, and when the skirt is reapplied to the container neck the projections can push on the extension to push the extension off the securing ring and ensure that the band drops away from the skirt.

The projections may be arranged to be in driving engagement with the notches as the closure is screwed onto the container neck, whereby to help with co-rotation of the skirt and the band during application.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

The present invention will now be more particularly described, by way of example, with reference to the accompanying drawings, in which.

Figure 1:
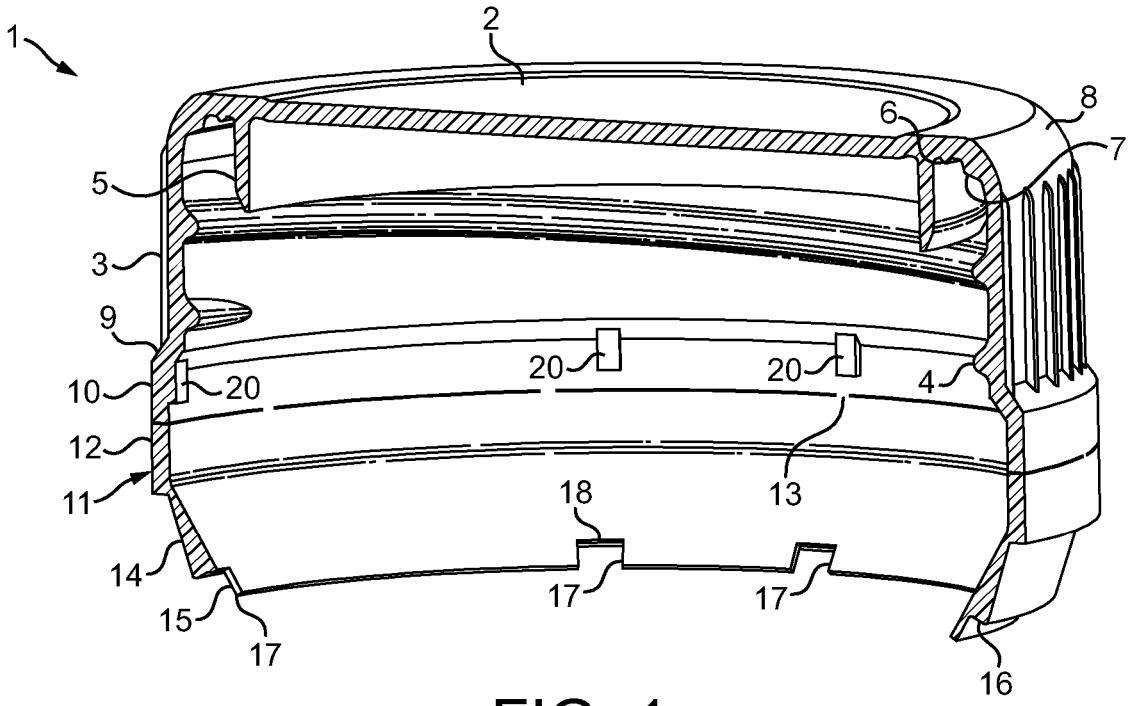
FIG. 1 is a partial section of a closure formed according to the present invention.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

In the following description, all orientational terms, such as upper, lower, radially and axially, are used in relation to the drawings and should not be interpreted as limiting on the invention.

Referring first to FIG. 1 there is shown a closure generally indicated 1.

The closure 1 comprises a generally circular top plate 2 and a generally cylindrical side skirt 3 which depends from the periphery of the plate 2.

The interior of the skirt 3 has a screw thread formation 4 for engaging a corresponding formation on the exterior of a container neck.

An annular sealing projection 5 depends from the underside of the top plate 2 and in use fits into the bore of the container neck. Additionally an annular sealing bead 6 is provided on the underside of the top plate 2 for sealing against the top of the container neck rim; and a further sealing bead 7 is provided on the interior of a curved shoulder 8 which forms the interface between the side skirt 3 and the top plate 2; the bead 7 seals against the corner of the container neck rim.

At the end of the skirt 3 opposite the top plate 2 an inclined radial step 9 is provided and a terminal skirt portion 10 continues from the step 9. A plurality of bearing projections 20 are provided on the portion 10 and extend slightly into the step 9.

At the lower end of the portion 10 a tamper-evident drop band 11 is provided. A first portion 12 of the band 11 is frangibly attached to the portion 10 by a plurality of frangible bridges 13.

At the lower end of the band first portion 12 a flap-like, generally triangular-section second portion 14 extends. At the end of the second portion 14 an extension 15 extends axially. The extension extends from the inner edge of the portion 14 so that the remainder of the free edge of the portion 14 forms an abutment surface 16.

The extension 15 comprises a plurality of arcuate extension sections 17 punctuated/spaced by notches 18.

In FIG. 1 the closure is shown in an as-moulded condition, with the second portion 14 in a downwardly inclined position extending away from the top plate 2.

Figure 2:
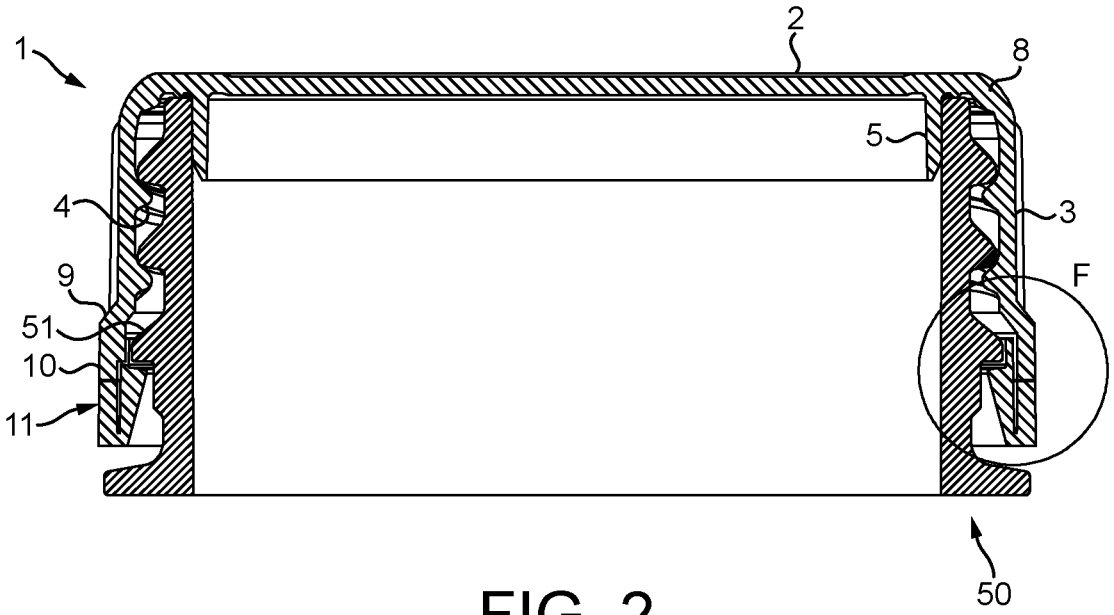
FIG. 2 shows the closure of FIG. 1 fitted onto a container neck.
Figure 3:
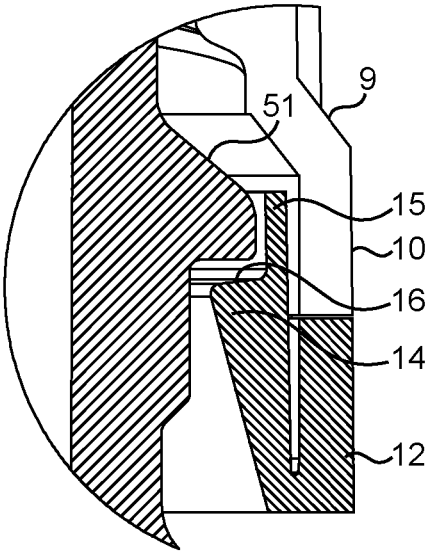
FIG. 3 is a magnified view of area F in FIG. 2.
Figure 4:
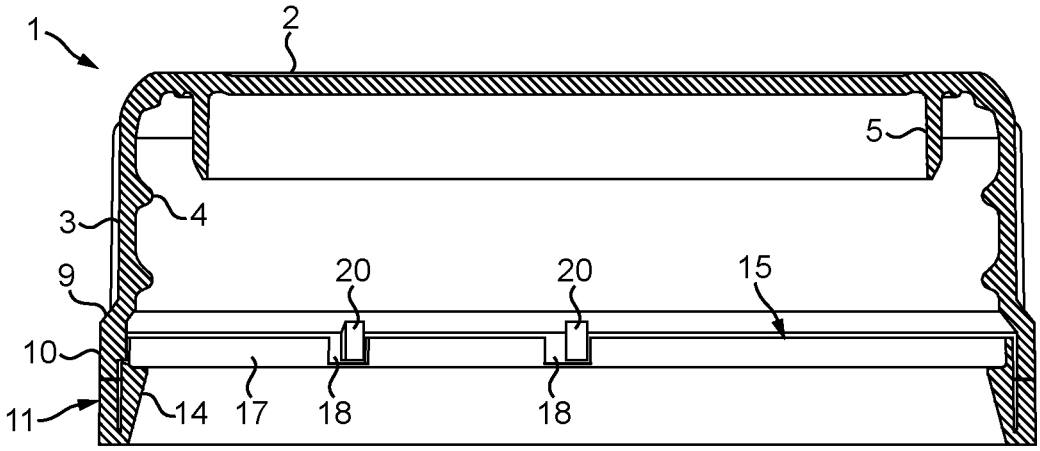
FIG. 4 shows the closure of FIG. 2 in the absence of the container neck for explanatory purposes.

FIGS. 2 to 4 show the closure in a working condition, in which the second portion 14 is upturned and folded over inwardly and upwardly towards the top plate 2.

When the closure 1 is applied axially down onto a container neck 50 the second portion 14 can pass over a securing ring 51 to the fully screwed-on position shown in FIGS. 2 and 3. In this position the abutment surface 16 is located under the ring 51 and the extension 15 extends so as to be positioned between the ring 51 and the skirt portion 10. As shown best in FIG. 4, it will also be noted that projections 20 engage into notches 18. The notches are slightly wider than the projections and the projections are arranged to locate at one side of the notches. This means that the projections engage one lateral side of the notches when the closure is being screwed onto a container neck. In this embodiment the notches are generally oblong, with each lateral side being axial/straight (parallel to the skirt); and the corresponding side of the projection is the same so that they are parallel to each other to provide a good abutment. The engagement helps to cause co-rotation of the skirt and the band, which helps to support the frangible bridges (which would normally cause the co-rotation). This relieves stress on the frangible bridges and allows for the bridges to be reduced in thickness/section if desired in certain embodiments, which then makes breakage of the bridges easier in use.

Figure 5:
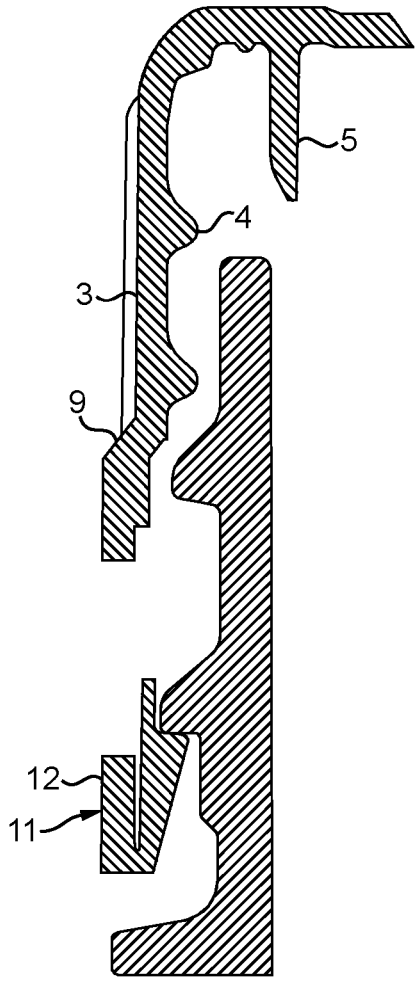
FIG. 5 shows the closure/neck of FIG. 2 following first removal of the closure.

When the closure 1 is unscrewed from the neck 50 for the first time the skirt 3 rotates and moves axially upwards. The abutment surface 16 prevents the band 11 from following and the frangible bridges 13 are broken. It will be noted that because the extension 15 is positioned "behind" (i.e. juxtapose) the ring 51 this prevents the second portion from being folded down as the closure is unscrewed i.e. this helps to prevent retain the band under the ring. In addition, engagement of the projections of the skirt in the notches band can be used to help to cause breakage of the bridges. The skirt is therefore unscrewed and the band remains on the neck, as shown in FIG. 5.

In some cases the band will drop down when the closure is unscrewed. However, it is also possible that the extension lightly "grips" the ring after the band is released from the skirt, as shown in FIG. 5.

Figure 6:
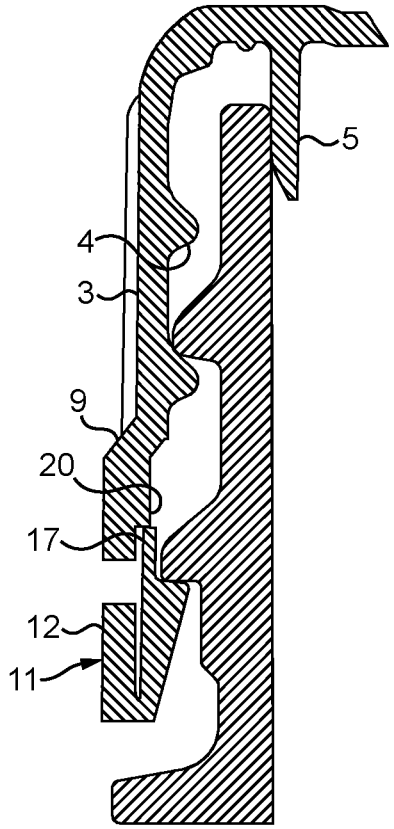
FIG. 6 shows the closure of FIG. 5 as it is partially reapplied to the container neck.
Figure 7:
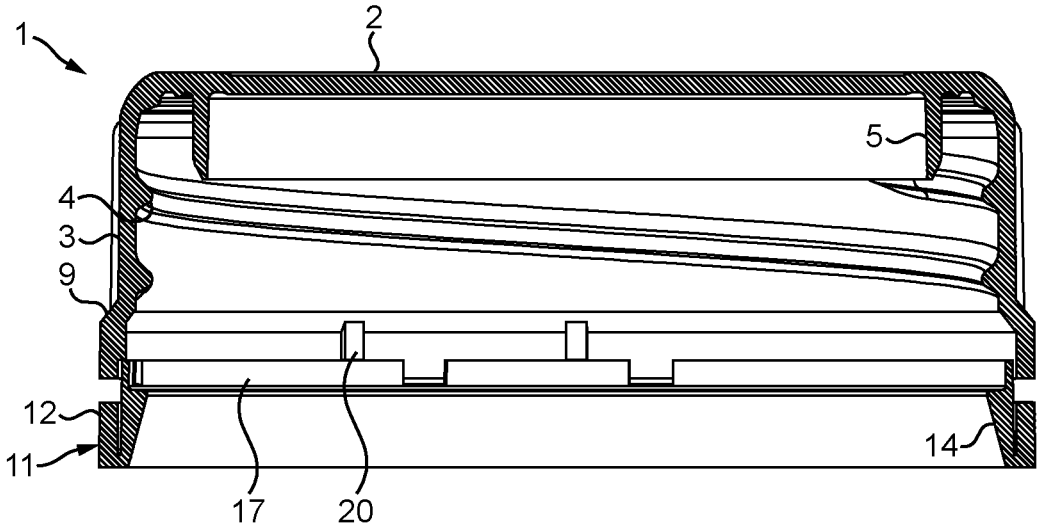
FIG. 7 shows the arrangement of FIG. 6 in the absence of the container neck for explanatory purposes.
Figure 8:
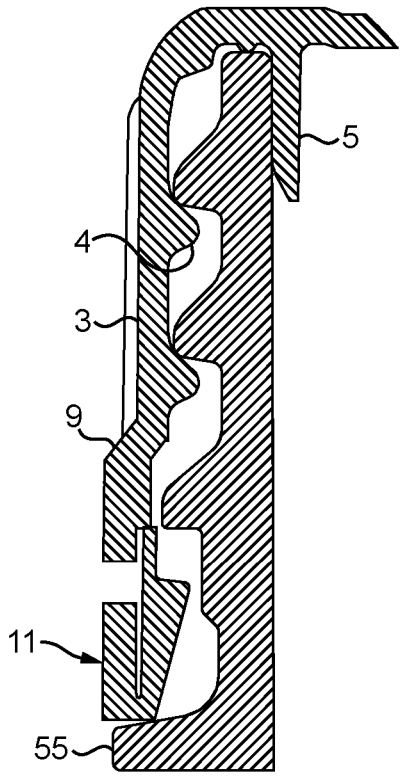
FIG. 8 shows the closure of FIG. 6 with the closure fully reapplied.

If the band remains on the ring, then when the skirt is reapplied the projections 20 will come to bear on the extension sections 17, as shown in FIGS. 6 and 7. As the skirt is screwed back down to the fully screwed on position the projections will then push the band away from the skirt and push the extension sections off the ring, so that the band will drop down and, in this embodiment, sit on the neck transfer bead 55, as shown in FIG. 8. This means, therefore, that the band will always drop down (either naturally when the bridges break, or due to the bearing projections).

The circumferential extent of the notches is very small compared to the extent of the flaps, so the chances of the projections re-aligning with the notches when the closure is reapplied is very low.

Figure 9:
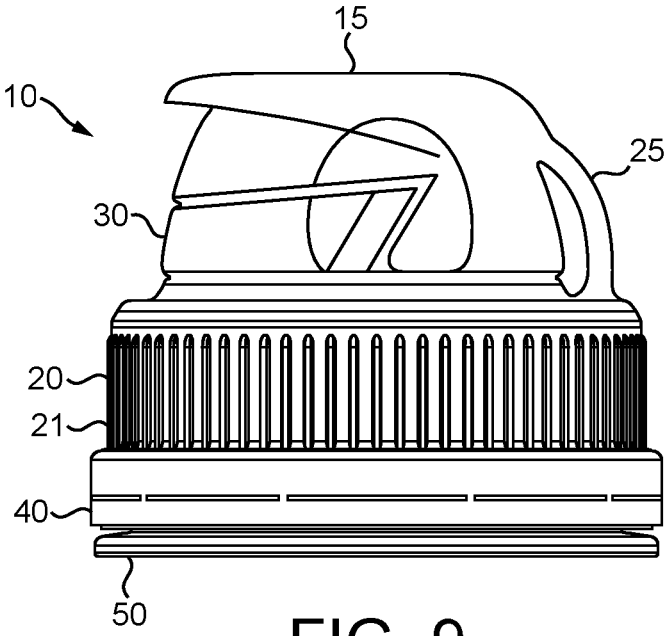
FIG. 9 shows a closure formed according to the present invention and shown fitted onto a container neck and in an unopened condition.
Figure 10:
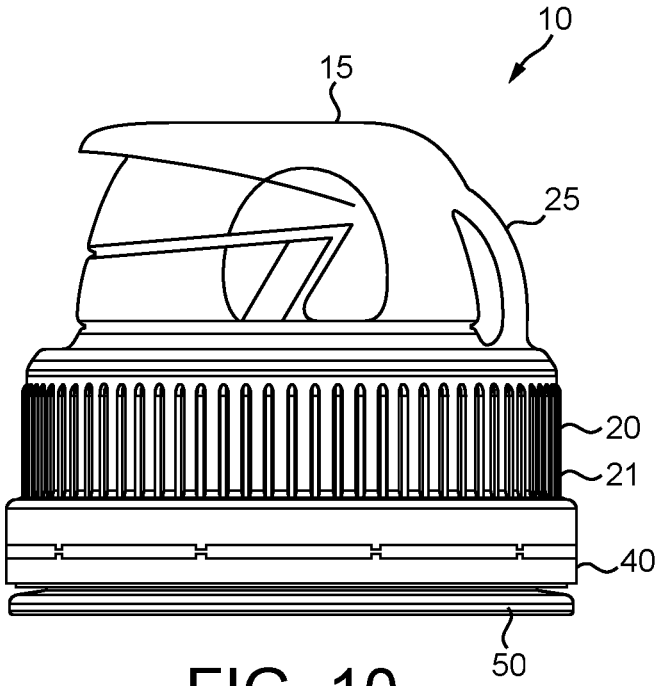
FIG. 10 is the closure of FIG. 9 following removal and reapplication to the container neck.

Referring now to FIGS. 9 and 10 there is shown a flip-top (sportscap) tamper-evident closure 110. The closure 110 includes a lid 115 connected to a base 120 by a hinge 125.

A tamper-evident strip 130 is provided to connect the lid 115 and the base 120 and must be torn off to allow the lid to be opened to reveal a drinking spout.

The base 120 includes a sidewall 121 and at the free end of the sidewall is a tamper-evident drop band 140.

If the band breaks 140 away from the sidewall 121 and then the closure is screwed back down, the sidewall now pushes down on the band flap extension and this pushes the band 40 down, as shown in FIG. 4B to form and maintain a gap to evidence opening of the closure.

By using the closure base to push down on the folded flap part of the drop band this ensures that there is a clear gap between the free end of the sidewall and the broken away drop band.

If the band has already dropped the gap G is maintained; if the band remains on the bead then it is pushed off the bead and down away from the sidewall as the closure is reapplied.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A tamper-evident screw closure, the tamper-evident screw closure comprising:

a head plate;

a substantially cylindrical skirt having an internal screw thread; and a tamper-evident drop band, the tamper-evident drop band being frangibly connected to the lower edge of the substantially cylindrical skirt, the tamper-evident drop band comprising a first portion directed downwardly from the substantially cylindrical skirt and a second portion which extends from a lower end of the first portion and which is folded over inwardly and back in the direction of the head plate for engaging behind a securing ring on a container neck, at least one extension is provided in axial extension of the second portion, wherein the at least one extension is provided with one or more notches and the interior of the substantially cylindrical skirt is provided with one or more corresponding projections which locate in the one or more notches when the second portion is folded, and wherein when the tamper-evident screw closure is unscrewed, the substantially cylindrical skirt breaks away from the tamper-evident drop band, and when the substantially cylindrical skirt is reapplied to the container neck the one or more projections can push on the extension to ensure that the tamper-evident drop band drops away from the substantially cylindrical skirt.

2. The tamper-evident screw closure as claimed in claim 1, in which the or each notch is formed at the free edge of the at least one extension.

3. The tamper-evident screw closure as claimed in claim 1, in which the or each notch is generally quadrilateral in shape.

4. The tamper-evident screw closure as claimed in claim 1, in which the at least one extension comprises one or more flaps.

5. The tamper-evident screw closure as claimed in claim 1, in which the at least one extension comprises a plurality of flaps.

6. The tamper-evident screw closure as claimed in claim 5, in which the plurality of flaps are arcuate and are circumferentially spaced from each other by the one or more notches.

7. The tamper-evident screw closure as claimed in claim 1, in which the one or more projections are in driving engagement with the one or more notches as the tamper-evident screw closure is screwed onto a container neck, whereby to help with co-rotation of the substantially cylindrical skirt and the tamper-evident drop and during application.

8. The tamper-evident screw closure as claimed in claim 1, in which the one or more projections are in driving engagement with the, or at least some of the, one or more notches as the tamper-evident screw closure is unscrewed whereby to assist with breakage of the frangible connection with the tamper-evident drop band.

9. The tamper-evident screw closure as claimed in claim 1, in which the second portion has a generally triangular section.

10. The tamper-evident screw closure as claimed in claim 1, in which the one or more projections are generally square or rectangular.

11. The tamper-evident screw closure as claimed in claim 1 in combination with a container.

12. A tamper-evident screw closure for a container, the tamper-evident screw closure comprising a base or a body attachable to a container neck, the base or the body comprising a sidewall having a substantially cylindrical cap skirt and a tamper-evident drop band, the tamper-evident drop band comprising a first portion directed downwardly, from the substantially cylindrical cap skirt and a second portion which extends from a lower end of the first portion and which is folded over inwardly and back towards the substantially cylindrical cap skirt for engaging behind a securing ring on a container neck, at least one extension is provided in axial extension of the second portion, wherein the at least one extension is provided with one or more notches and the interior of the substantially cylindrical cap skirt is provided with one or more corresponding projections which engage in the one or more notches when the second portion is folded, when the closure is unscrewed the body or the base breaks away from the tamper-evident drop band, and when the substantially cylindrical cap skirt is reapplied to the container neck the one or more corresponding projections can push on the at least one extension to ensure that the tamper-evident drop band drops away from the body or the base.

13. The tamper-evident screw closure as claimed in claim 12, in which the or each notch is formed at the free edge of the at least one extension.

14. The tamper-evident closure as claimed in claim 12, in which the or each notch is generally quadrilateral in shape.

15. The tamper-evident screw closure as claimed in claim 12, in which the at least one extension comprises one or more flaps.

16. The tamper-evident screw closure as claimed in claim 12, in which the at least one extension comprises a plurality of flaps.

17. The tamper-evident screw closure as claimed in claim 16, in which the plurality of flaps are arcuate and are circumferentially spaced from each other by the one or more notches.

18. A flip-top sportscap closure for a container neck, the flip-top sportscap closure comprising a screw-threaded base and a lid joined by a hinge, the screw-threaded base comprising a sidewall at one end of which a tamper-evident drop-hand is frangibly connected, the tamper-evident drop band comprising a first portion directed downwardly from the sidewall and a second portion which extends from a lower end of the first portion and which is folded over inwardly and back in the direction of the lid for engaging behind a securing ring on a container neck, at least one extension is provided in axial extension of the second portion, wherein the at least one extension is provided with one or more notches and the interior of the sidewall is provided with one or more projections which engage in the one or more notches when the second portion is folded, when the flip-top sportscap closure is unscrewed the screw-threaded base breaks away from the tamper-evident drop band, and when the sidewall is reapplied to the container neck the one ore more projections can push on the at least one extension to ensure that the tamper-evident drop band drops away from the screw-threaded base.

19. In combination, a tamper-evident screw closure and a container neck, the tamper-evident screw closure comprising: a head plate; a substantially cylindrical skirt having an internal screw thread, and a tamper-evident drop band, the band being frangibly, connected to a lower edge of the substantially cylindrical skirt, the tamper-evident drop band comprising a first portion directed downwardly from the substantially cylindrical skirt and a second portion which extends from a lower end of the first portion and which is folded over inwardly and back in the direction of the head plate for engaging behind a securing ring on the container neck, at least one extension is provided in axial extension of the second portion, wherein the at least one extension is provided with one or more notches and the interior of the substantially cylindrical skirt is provided with one or more projections which can locate in the one or more notches when the second portion is folded, and wherein when the tamper-evident screw closure is unscrewed the substantially cylindrical skirt breaks away from the tamper-evident drop band, and when the substantially cylindrical skirt is reapplied to the container neck the one or more projections can push on the at least one extension to push the at least one extension off the securing ring and ensure that the tamper-evident drop band drops away from the substantially cylindrical skirt.

20. The combination as claimed in claim 19, in which the one or more projections are arranged to be in driving engagement with the one or more notches as the tamper-evident screw closure is screwed onto the container neck, whereby to help with co-rotation of the substantially cylindrical skirt and the tamper-evident drop band during application.

* * * * *